US005550350A

United States Patent [19]

Barnes

[11] Patent Number: 5,550,350

[45] Date of Patent: Aug. 27, 1996

[54] HEATED ICE-MELTING BLOCKS FOR STEPS

[75] Inventor: Donald W. Barnes, P.O. Box 211313, Anchorage, Ak. 99504

[73] Assignees: Donald W. Barnes; Dennis N. Dunham, both of Anchorage, Ak.

[21] Appl. No.: 341,362

[22] Filed: Nov. 17, 1994

[51] Int. Cl.[6] ..... H05B 3/10

[52] U.S. Cl. ..... 219/213; 219/544; 219/548

[58] Field of Search ..... 219/213, 544, 219/548–549, 528–529; 15/DIG. 15, 215–217; D6/583

[56] References Cited

U.S. PATENT DOCUMENTS

| | | | |
|---|---|---|---|
| 2,138,217 | 11/1938 | Sutter | 219/544 |
| 2,745,942 | 5/1956 | Cohen | 219/46 |
| 2,844,696 | 7/1958 | Custer | 219/19 |
| 3,164,820 | 1/1965 | Hulett | 340/234 |
| 3,500,444 | 3/1970 | Hesse et al. | 219/544 |
| 3,806,702 | 4/1974 | Spencer | 219/528 |
| 3,861,029 | 1/1975 | Smith-Johannsen et al. | 29/611 |
| 4,188,276 | 2/1980 | Lyons et al. | 204/159.17 |
| 4,197,449 | 4/1980 | Fessenden | 219/528 |
| 4,242,573 | 12/1980 | Batliwalla | 219/528 |
| 4,318,881 | 3/1982 | Sopory | 264/346 |
| 4,388,607 | 6/1983 | Toy et al. | 338/22 |
| 4,426,339 | 1/1984 | Kamath et al. | 264/22 |
| 4,459,473 | 7/1984 | Kamath | 219/553 |
| 4,486,649 | 12/1984 | Lane | 219/536 |
| 4,560,498 | 12/1985 | Horsma et al. | 252/511 |
| 4,564,745 | 1/1986 | Deschenes | 219/213 |
| 4,794,228 | 12/1988 | Braun, Jr. | 219/544 |
| 4,814,580 | 3/1989 | Carageorge | 219/213 |
| 4,855,576 | 8/1989 | Sterwald | 219/544 |
| 4,926,026 | 5/1990 | Tarry | 219/213 |
| 4,967,057 | 10/1990 | Bayless et al. | 219/213 |
| 5,003,157 | 3/1991 | Hargrove | 219/213 |
| 5,039,845 | 8/1991 | Clough et al. | 219/528 |
| 5,204,159 | 4/1993 | Tan | 15/215 |
| 5,380,988 | 1/1995 | Dyer | 219/213 |

*Primary Examiner*—Teresa J. Walberg
*Assistant Examiner*—Raphael Valencia
*Attorney, Agent, or Firm*—Medlen & Carroll

[57] ABSTRACT

A device and method for melting ice and snow from walkways and steps is described. The device includes a rigid block of heat-conducting plastic suitable for mounting on steps. An electrical heating element provides heat. The heat is distributed to the entire block and melts the snow or ice on the surface.

16 Claims, 3 Drawing Sheets

HEATED ICE-MELTING BLOCKS FOR STEPS

FIELD OF THE INVENTION

The invention generally relates to a de-icing device, and in particular, a de-icing device that can be used on steps of a walkway.

BACKGROUND OF THE INVENTION

Snow and sleet on walkways make for hazardous, slippery conditions for pedestrians. Typically, ameliorative measures comprise shoveling deep snow from the path and scattering sand or salt over the remaining icy layer to promote melting. However, the sand and salt still require cooperation from the weather; although they promote melting at low temperatures, when the air temperature is too cold, the ice won't melt readily so the sand and salt are not effective.

As an alternative, electrically heated devices have been employed. One solution, offering a permanently installed de-icing device, is a precast heating panel having a flexible electric heating element embedded in fiber-enforced mortar which serves as the walkway, itself (U.S. Pat. No. 4,564,745 to Deschenes). Similarly, U.S. Pat. No. 4,814,580 to Carageorge describes a thermal walkway built of bricks having embedded electrical heating elements. Installation of these systems is costly. Moreover, if the electrical heating element fails, repair requires breaking through the existing walkway to reach the electrical parts. Further, these devices are only useful where permanently-installed devices are feasible. They do not offer a means to prevent ice build-up on existing walkways and steps.

Electrically heated de-icing devices that are simply laid over existing walkways provide a solution that has more widespread commercial appeal as a method of clearing ice from entranceways. One example of such a device is embodied in a flexible mat composed of two sheets with a heating element in between. However, these particular devices are unsatisfactory when there is heavy snowfall. In such circumstances, people find it necessary to shovel off the deep snow, relying on the heating element merely to prevent an icy layer from forming. The flexible mats are susceptible to damage from the snow shoveling implements; the mat itself can be pierced, thus damaging the electrical heating element inside. Since the mats are made of flexible material, the heating elements within are subject to wear from the flexing and bending resulting from the weight of persons walking on the mats. Furthermore, a rubber mat is not a good thermal conductor, so means for conducting the heat to the surface of the mat are required.

Some de-icing mats have been made more protective of the electrical heating elements inside by substituting for the flexible sheets, interleaved link elements, which have hollow metal tubes containing electrical heating elements sealed within. This serves to protect the electrical wires from sharp instruments, but it makes shoveling the snow extremely difficult because it presents an uneven surface for the snow shovel. Furthermore, a mat composed of hollow tubes does not provide very safe footing.

What is needed is a de-icing device that can be placed over existing walkways, including steps, can be employed compatibly with snow shoveling implements, is not susceptible to damage by sharp implements, provides said footing and can be replaced at low cost.

SUMMARY OF THE INVENTION

The invention generally relates to a de-icing device, and in particular, a de-icing device that can be mounted on steps of a walkway. The present invention contemplates a device for melting ice having capability for mounting over steps, comprising a rigid block of plastic having heat-conducting capability whose bottom surface has an embedded channel; a heating element mounted within the channel having a first end; electrical coupling means for coupling the heating element to a source of power at the first end of the heating element within the channel; and a heat distributing material covering the channel and in thermal conducting contact with the heating element so that the heat is distributed to the heat conducting plastic block. In one embodiment, the heating element is a self-regulating pipe heating cable.

In one embodiment, the heat distributing material is disposed in a single layer along the bottom of the block. The heat distributing material is preferably foil tape. In one embodiment, the plastic is acrylonitrile butadiene styrene (ABS) plastic. In another embodiment, the plastic is combined with an additive having heat-conducting capacity.

In one embodiment of the invention, the electrical coupling means is an electric power cord. In a preferred embodiment, the device also comprises a ground fault circuit interrupter electrically coupled to the power cord for safety. Also for safety, the top surface of the block has a gritty surface which may be molded into the plastic. The gritty surface acts to prevent falls by providing a rough surface for better footing. The surface is not so uneven, however to interfere with the movement of a snow shovel over the surface.

The present invention also contemplates a device for melting ice having capability for mounting over steps, comprising: a plurality of heat conducting rigid plastic blocks, the bottom surface having a channel embedded therein; a heating element mounted within the channel and extending from the channel of one block to the channel of the next block, the length of the heating element exposed between blocks being at least the height of the riser of the steps, the heating element having a first end; electrical coupling means tier coupling the heating element to a source of power at the first end of the strand within the channel; and a single layer of heat distributing material covering the channel and in thermal conducting contact with the heating element so that the heat is distributed to the heat conducting plastic block. In one embodiment the device further comprises flexible tubing surrounding and coextensive with the exposed heating element. The heating element may be a self-regulating pipe heating cable. The heat distributing material may be foil tape. The top surface of the block may be formed with a gritty surface. In one embodiment the gritty surface is molded into the plastic.

Another aspect of the invention is a method for melting snow and ice from a step, comprising: a) mounting a heating device on the step, wherein the device includes a block of plastic having a channel embedded therein, a heat-generating element within and coextensive with the channel, and a power source coupled to the heat-generating element; and b) conducting electricity from the power source to the heat generating element so that the heat generating element generates heat and the heat is distributed to the block so that snow and ice on the top surface of the block melt from the heat.

It is not intended that the invention be limited to use on any particular type of surface. For example, the device mounts over cement or wood walkways and steps or can be laid on the ground. It is not intended, either that the device be limited to the particular materials described as examples. Other rigid plastics and heat distributing materials are possible.

DESCRIPTION OF THE PREFERRED EMBODIMENT

Figure 1:
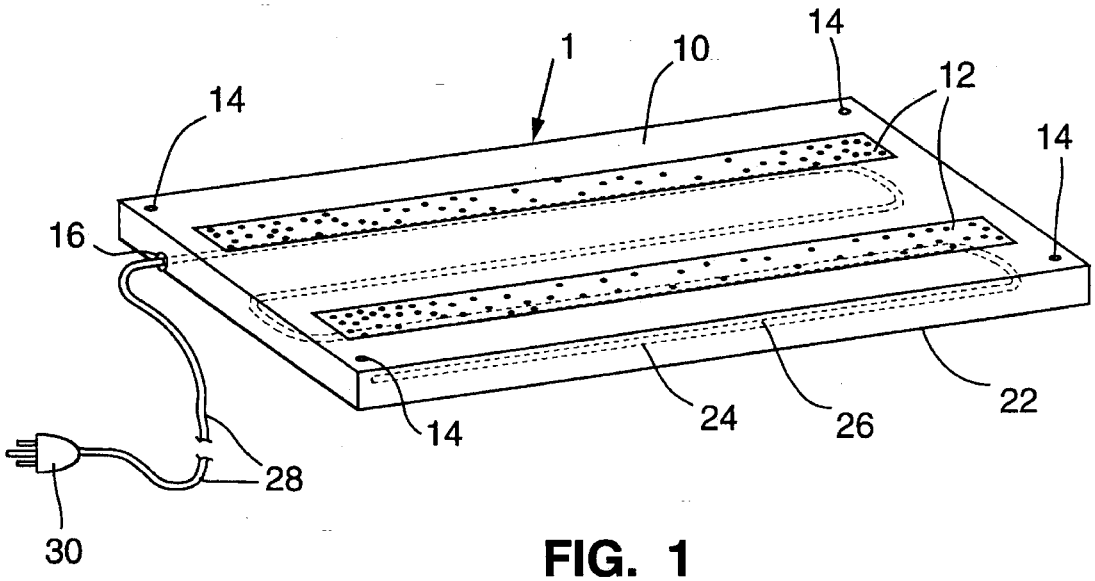
FIG. 1 is a perspective view of the device of the present invention.
Figure 2:
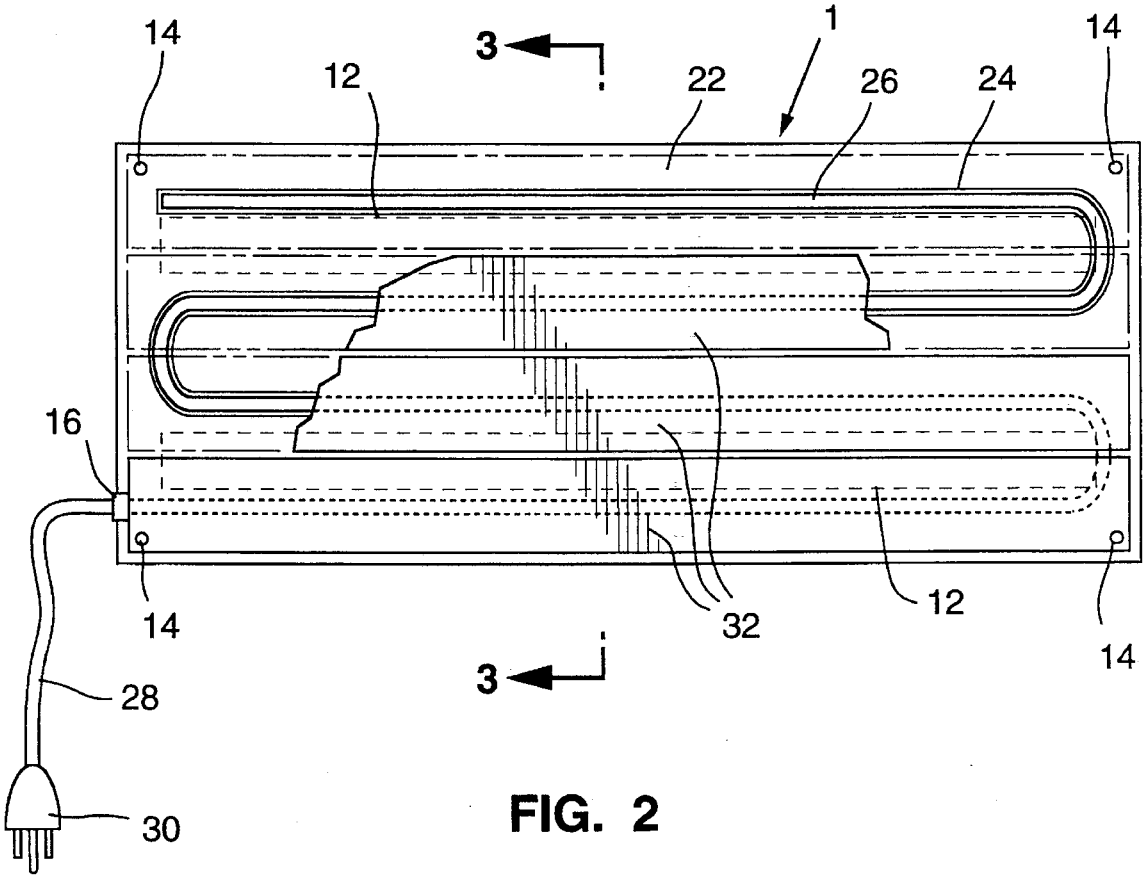
FIG. 2 is a cutaway perspective view of the bottom surface of the device shown in FIG. 1.
Figure 3:
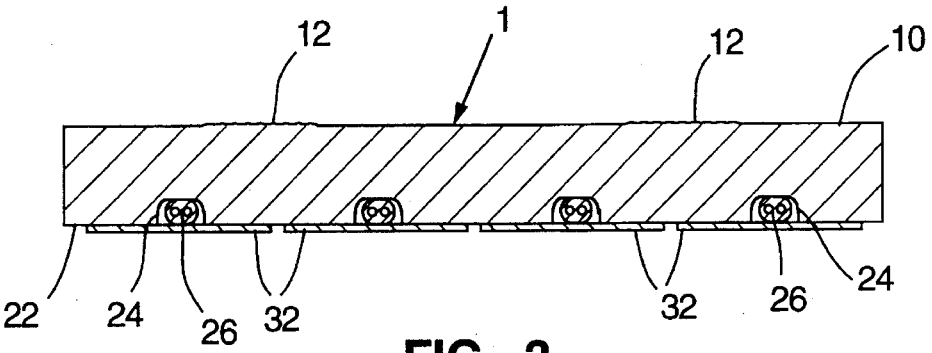
FIG. 3 is a cross-sectional view of the device shown in FIG. 2 along the lines of 3—3.

The invention generally relates to a de-icing device, and in particular, a deicing device that can be used on steps of a walkway. As shown in FIGS. 1–3, a preferred device comprises a rigid block (1) formed of plastic, having heat-conducting capability. The rigid block protects the internal components of the device from the weight of persons walking on it and from snow scraping implements, and the like, which may be brought into forceful contact with the block. The block has the additional characteristic of being a good conductor of heat which facilitates rapid heating of the entire block. The preferred material holds up in heat and cold, doesn't corrode, and conducts heat well. In one embodiment metallic strips are embedded in the plastic for improved heat diffusivity. In an alternate embodiment, the plastic contains discontinuous glass fibers (e.g. Polycarbonate (Lexan) or Polyphenyleneoxide (Noryl)) available from General Electric Plastics (Pittsfield, Mass.).

The rigid block has a top surthce (10) and a bottom surface (22). The bottom surface has an open channel (24) embedded therein. The channel (24) may be in any convenient configuration which extends in a non-broken pattern such as, for example, a serpentine or a zig-zag pattern. Within the channel (24) is a heating element (26) which extends the full length of the channel. One end of an electric power cord (28) is electrically coupled to one end of the heating element (26) within the channel. For use with a standard wall outlet, the power cord (28) has a male electric plug (30) at its other end configured for coupling to and receiving power from the power source. One embodiment uses a power cord that is 14/2 arctic cable for durability and flexibility in the cold.

A heat conducting strip (32) is adhered to the bottom surthce (22) of the block, covering the open channel (24). The heating element (26) is in thermal conducting contact with the heat conducting strip (32) so that heat generated by the heating element is conducted along the heat conducting strip (32) to the bottom surface of the block. The heat conducting strip (32) is a good conductor of heat, as for instance, certain plastics or metals (e.g. aluminum, copper, brass). The heat conducting strip may take alternative forms such as a metal sheet, foil or screen. In a preferred embodiment, the heat conducting strip (32) is disposed in a single layer, more preferably, as foil tape. A single layer of the foil tape (32) adhered to the bottom surface (22) works to spread the heat evenly along the bottom surface of the block. Since the plastic block (1) is a good heat conductor, when connected to the power source, the entire block heats up and melts snow or ice in contact with it.

The heating element (26) is preferably an insulated resistance wire and, more preferably, a self-regulating pipe heating cable which shuts down when the snow or ice on its surface thaws. It is preferred that the heating element have flattened dimensions. The self-regulating pipe heating cable is essentially described in U.S. Pat. No. 4,967,057 to Bayless et al. Commercially available self-regulating pipe heating cable has a small, flattened oval cross section and includes an electrically insulating outer sheath enclosing two uniformly spaced physically parallel wires. Between the wires, and extending throughout the length of the wires is an electrically resistive heating material. Such a material is sold by the Raychem Corporation of Menlo Park, Calif. under the trade name "FROSTEX" self-regulating pipe heating cable. Any convenient brand may be used.

The resistance material of the self regulating pipe heating cable exhibits a property whereby, over the useful range of temperatures, i.e. the normal outdoor environmental temperatures of below the freezing temperature of snow and ice (32° F.) to approximately 100° F., the resistance has a positive temperature coefficient (PTC) and may be referred to as PTC material. The heat output of the self regulating pipe heating cable is approximately 3 watts per foot at 50° F. (and varies generally linearly over its useful range from 6.5 watts per foot at 0° F. to 0.6 watts per foot at 100° F. when operating at 110 volts A.C. The heater thus provides about 35 watts at 32° F. and about 23 watts at 50° F). The heat generated within the resistance material is dissipated by conduction through the heat-conducting strip and the plastic block and therefrom to the environment, including ice and snow on the top surface of the block. The PTC material makes the self regulating pipe heating cable self protecting, without the requirement or the use of additional thermostatic switches or other temperature responsive controls, since its heat output is quite low, although sufficient to keep snow from accumulating on the upper surface. In a dry condition the heat output to the environment keeps the temperature of the block and the corresponding power consumption, which reach a steady state condition, at an acceptable level. Similarly, when wet, the wattage output is sufficiently low to keep the mat within acceptable temperature limits.

The device is not intended to be limited by the type of power source. For example, the power may be from an electrical socket, or from a battery. In one embodiment, a plug having a ground fault circuit interrupter (34) is provided to protect against electrical hazards such as shocks.

The block is preferably formed from molded plastic. In a preferred embodiment, the top surface (10) has a non-slip gritty surface (12) which may be applied as an adhesive strip or may be molded into the plastic. As used herein, gritty refers to a rough surface quality like that of coarse sandpaper. In a preferred embodiment, the block is hollow and is formed from two separate pieces that are fitted together to form the block. In this embodiment, a rubber gasket sits between the plastic pieces to form a watertight seal. In one alternative of this embodiment the heating element is placed in a serpentine or zig-zag configuration inside the hollow block, rather than within channels on the bottom surface of the block.

The block has a plurality of holes (14) extending from the top surface (10) to the bottom surface (22) near the center line of the block. The holes (14) are spaced to avoid intersecting with the channel (24). The holes (14) extend through the heat conducting strip (32) and are used in conjunction with hardware for anchoring the blocks to the steps or walkway. The holes (14) will accept wood screws, concrete anchors or other appropriate hardware. The holes can be countersunk to provide a smooth top surface on the block and the hardware can include a cap which covers the screw head and is flush with the top surthce to make the block water tight.

Figure 4:
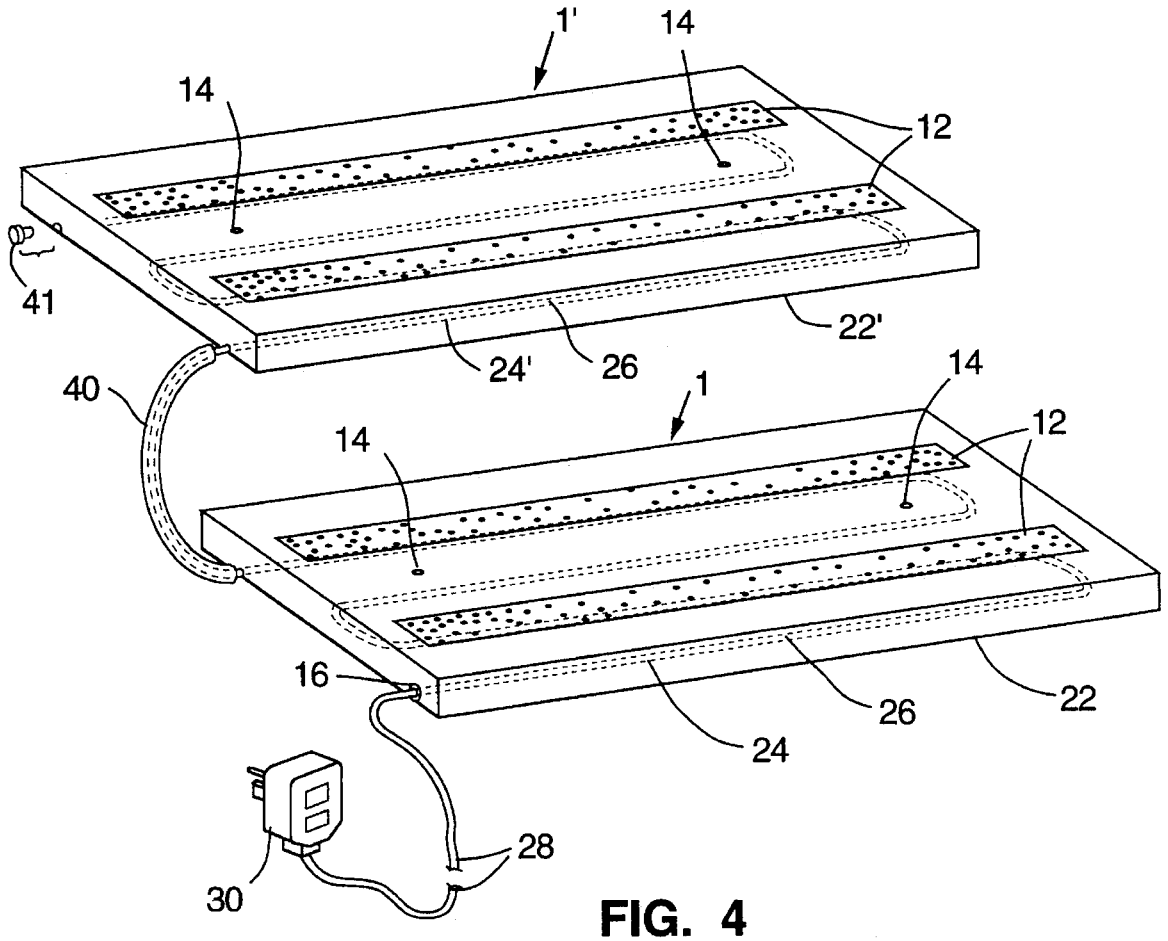
FIG. 4 shows an embodiment of a device suitable for the practice of the present invention, having multiple blocks.

In one embodiment of the device for de-icing steps, as shown in FIG. 4, the device comprises a plurality of rigid plastic blocks (1, 1'). The individual blocks are essentially as described for the single block embodiment. The bottom surface (22) of each block has a channel (24, 24') embedded therein. A single heating element (26) sits within the channel (24) and extends from the channel of one block (24) to the channel of the next block (24'). The length of the heating element that is exposed between the blocks is at least the height of the riser of the steps. As used herein, the riser refers to the vertical face of the stair step. An electric power cord (28) is electrically coupled to one end of the heating element (26) within the channel (24) of the first block (1) in the series which serves to connect the heating element to a power source. The heat conducting strip (32) is mounted over the channel (24, 24') and over at least a portion of the bottom surthce (22, 22') of the blocks for even heat distribution to the blocks.

In a preferred embodiment, the exposed heating element is enclosed in a casing (40) to protect the heating element from weather and sharp objects. The casing may be formed of flexible tubing of approximately the same length as the heating element exposed between blocks. A stainless steel braid may serve as the tubing. The device may be customized to the number of steps of the individual user by removing blocks that are last in the series. Blocks may be removed by cutting the exposed heating element where it emerges from the preceding block and covering the open channel with a water tight plug (41).

Figure 5:
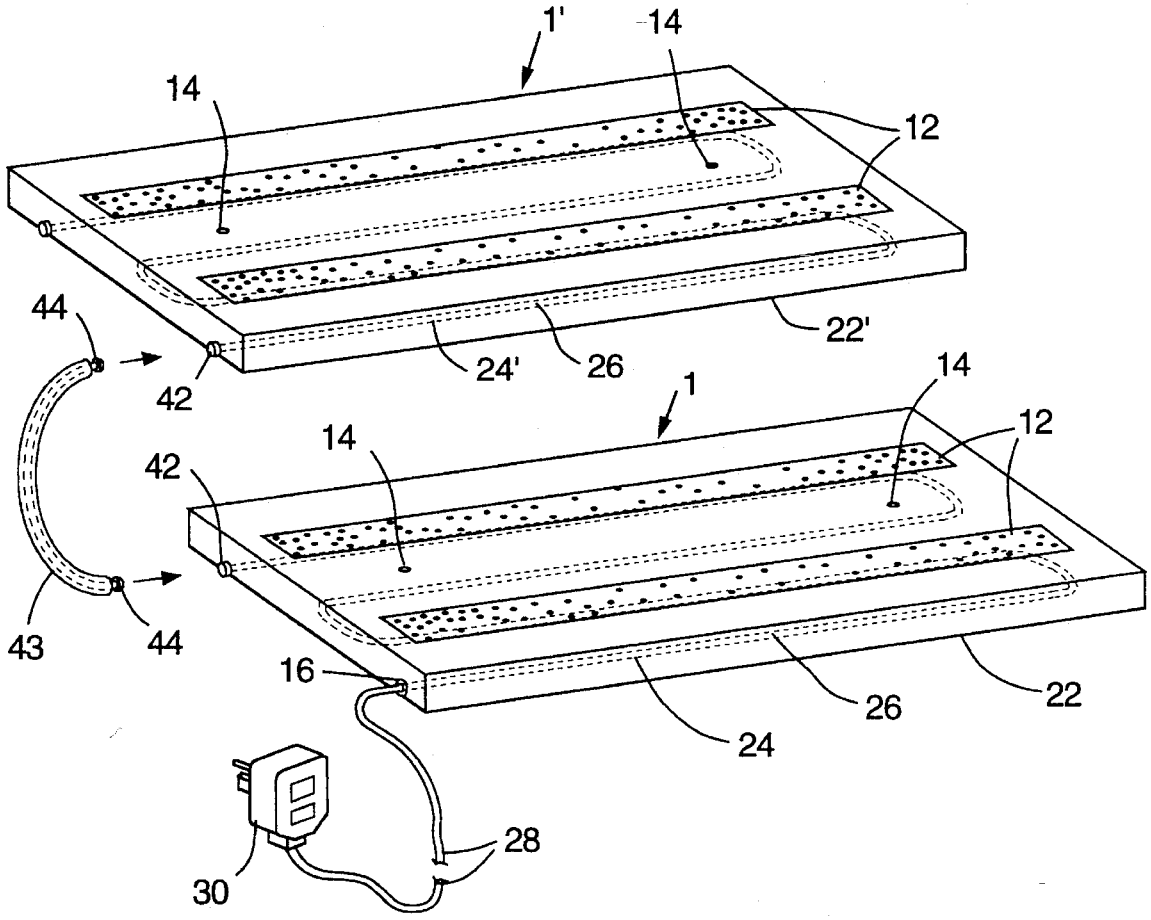
FIG. 5 shows an embodiment of the invention with multiple blocks.

In an alternate embodiment, shown in FIG. 5, the block (1) includes a plug receiving socket (42) coupled to each end of the heating element (26). In this embodiment, any number of blocks may be coupled together using patch cords (43) having plugs (44) on either end, of a size which fits into the plug receiving sockets. In this manner, two blocks are electrically coupled together by plugging a patch cord into a plug receiving socket of one block and a plug receiving socket of the following block. Instead of having two plug receiving sockets, the first block may have a power cord (28) for coupling to and receiving power from a power source. Additional blocks may then be added by coupling them, in daisy-chained fashion using patch cords, to the adjacent blocks.

Although embodiments have been described with some particularity, many modifications and variations of the preferred embodiment are possible without deviating from the invention.

The following U.S. patents assigned to Raychem Corporation and relevant to self-protecting strip heaters and conductive polymer technologies for PTC materials are incorporated herein by reference:

Smith-Johannsen et al. U.S. Pat. No. 3,861,029

Lyons et al. U.S. Pat. No. 4,188,276

Batliwalla U.S. Pat. No. 4,242,573

Sopory U.S. Pat. No. 4,318,881

Toy et al. U.S. Pat. No. 4,388,607

Kamath et al. U.S. Pat. No. 4,426,339

Kamath U.S. Pat. No. 4,459,473

Horsma et al. U.S. Pat. No. 4,560,498

I claim:

1. A device for melting ice having capability for mounting over steps, comprising:

a) a rigid block of heat-conducting plastic having a top surface and a bottom surface, said bottom surface having a channel embedded therein;

b) a heating element mounted within said channel, said heating element having a first end;

c) electrical coupling means for coupling said heating element to a source of power at said first end of said heating element within said channel; and d) a heat conducting strip covering said channel and in thermal conducting contact with said heating element so that the heat is distributed to said rigid block of heat-conducting plastic.

2. The device as recited in claim 1 wherein said heating element is a self-regulating pipe heating cable.

3. The device as recited in claim 1 wherein said heat conducting strip is disposed as a single layer.

4. The device as recited in claim 1 wherein said heat conducting strip is foil tape.

5. The device as recited in claim 1 wherein said electrical coupling means is an electric power cord.

6. The device as recited in claim 5 further comprising a ground fault circuit interrupter electrically coupled to said power cord.

7. The device as recited in claim 1 wherein the top surface of said block has a gritty surface.

8. The device as recited in claim 7 wherein said gritty surface is molded into said rigid block of plastic.

9. A device for melting ice having capability for mounting over steps, comprising:

a) a plurality of rigid plastic blocks having heat-conducting capability and having a top surface and a bottom surface, said bottom surface having a channel embedded therein;

b) a heating element mounted within said channel and extending from the channel of one block to the channel of the next block, the length of said heating element exposed between blocks being at least the height of a riser of a step, said heating element having a first end;

c) electrical coupling means for coupling said heating element to a source of power at said first end of said heating element within said channel; and d) a heat conducting strip covering said channel and in thermal conducting contact with said heating element so that the heat is distributed to said rigid block of heat-conducting plastic.

10. The device as recited in claim 9 further comprising a flexible tubing surrounding and coextensive with the length of said heating element exposed between blocks.

11. The device as recited in claim 10 wherein said heating element is a self-regulating pipe heating cable.

12. The device as recited in claim 9 wherein said heat conducting strip is foil tape.

13. The device as recited in claim 9 wherein said block is acrylonitrile butadiene styrene plastic.

14. The device as recited in claim 9 wherein the top surface of said block has a gritty surface.

15. The device as recited in claim 14 wherein said gritty surface is molded into said rigid block of plastic.

16. A method for melting snow and ice from a step, comprising:

a) mounting a heating device on the step, wherein the device includes a block of plastic having a channel embedded therein, a heating element within and coextensive wire said channel, and a power source coupled to said heating element; and b) conducting electricity from said power source to said heating element whereby said heating element generates heat which is distributed to said block such that snow and ice on the top surface of said block melts from the heat.

* * * * *

UNITED STATES PATENT AND TRADEMARK OFFICE

CERTIFICATE OF CORRECTION

PATENT NO. : 5,550,350
DATED : January 16, 1996
INVENTOR(S) : JAY A. YODER *ET AL.*

It is certified that error appears in the above-indentified patent and that said Letters Patent is hereby corrected as shown below:

At col. 1, line 66, please delete "said" and insert --safe--.
At col. 2, line 41, please delete "tier" and insert --for--.
At col. 3, line 24, please delete "deicing" and insert --de-icing--.
At col. 3, line 40, please delete "surthce" and insert --surface--.
At col. 5, line 7, please delete "surthce" and insert --surface--.

At col. 7, line 2, after "tensive" please delete "wire" and insert --with--.

Signed and Sealed this

Twenty-fourth Day of December, 1996

*Attest:*

Bruce Lehman

BRUCE LEHMAN

*Attesting Officer*

*Commissioner of Patents and Trademarks*